United States Patent [19]
Indra

[11] 4,452,196
[45] Jun. 5, 1984

[54] DEVICE FOR STOPPING A FUEL INJECTION ENGINE

[75] Inventor: Jaromir Indra, Brno, Czechoslovakia

[73] Assignee: Vysoke uceni technicke v Brne, Brno, Czechoslovakia

[21] Appl. No.: 314,017

[22] Filed: Oct. 22, 1981

[51] Int. Cl.³ ..... F02D 17/00
[52] U.S. Cl. ..... 123/198 DB; 123/198 D
[58] Field of Search ..... 123/198 D, 198 DB, 332, 123/333, 387, 385, 389, 379; 417/456, 440, 441, 505

[56] References Cited

U.S. PATENT DOCUMENTS

| | | | |
|---|---|---|---|
| 4,083,346 | 4/1978 | Eheim | 123/198 DB |
| 4,296,718 | 10/1981 | Baugh et al. | 123/198 DB |
| 4,304,201 | 12/1981 | Bleeke | 123/198 D |
| 4,318,379 | 3/1982 | Knorrcek | 123/198 DB |
| 4,319,550 | 3/1982 | Ishii et al. | 123/198 D |
| 4,351,293 | 9/1982 | Hewitt | 123/198 DB |
| 4,361,121 | 11/1982 | Chemers et al. | 123/198 DB |
| 4,388,900 | 6/1983 | Hoshi | 123/198 DB |

*Primary Examiner*—Raymond A. Nelli

[57] ABSTRACT

Device for stopping a fuel injection internal combustion engine by turning a key in a stopping box into the STOP position. In hitherto known devices, when turning the key into the said position, current feeding the coil of the electromagnetic valve during the operation of the engine is cut off, and this valve is closed then by means of a prestressed spring. This makes impossible a free outflow of fuel leaving the reducing valve of a low pressure circuit of the injection device, and directs all fuel delivered by a delivery pump into a hydraulic member, the piston of which, by means of fuel pressure, shifts the control bar into the position STOP; in this way the engine is stopped. Such known arrangement requires too much power, since the coil of the electromagnetic valve is energized by current all during the operation of the engine. In accordance with the invention the coil of the electromagnetic valve is deenergized current during the operation of the engine. Only when the key is turned into the STOP position is the electromagnetic valve energized for time needed for stopping the engine.

3 Claims, 1 Drawing Figure

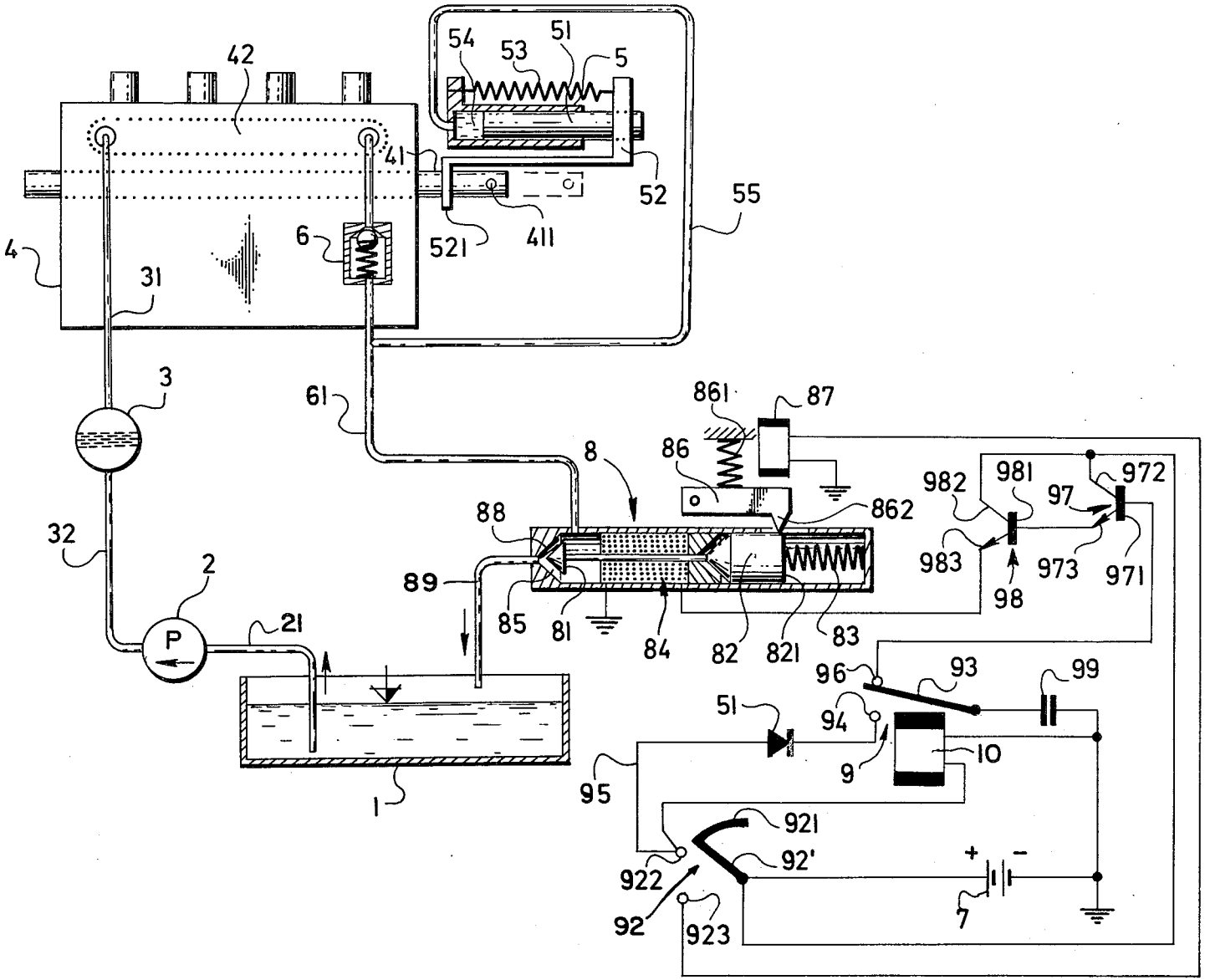
55
52
5
51
53
54
411
521
41
42
6
4
31
3
32
2
P
21
1
61
8
87
861
86
862
83
821
82
84
81
85
88
89
972
971
97
973
981
98
982
983
99
93
10
96
94
9
51
95
921
92'
922
92
923
7
+
-

DEVICE FOR STOPPING A FUEL INJECTION ENGINE

This invention relates to a device for stopping a fuel injection engine, especially one used in a vehicle, with which the fuel supply for the engine is provided by an injection pump which is filled by a delivery pump, excess fuel being returned through a pressure-reducing valve and thence to the fuel supply sump or tank. In such system, an electromagnetic valve is interposed in the piping which returns the superfluous fluid to the fuel tank, there being a hydraulic member the working space of which is connected by means of piping to the conduit returning the superfluous fluid between the pressure reducing valve and a valve controlled by the electromagnet, the electromagnetic valve being constantly urged by a pre-stressed spring into an open position. The said hydraulic member, by means of hydraulic pressure, may put a control bar of the fuel injection pump into a position in which the injection pump does not supply the engine with any fuel, the hydraulic member being selectively controlled as by a hand operated change-over switch, a switching relay, an exciting transistor, and a power transistor.

Hitherto known devices for stopping fuel injection engines, especially those employed in vehicles, are so arranged that when turning a key in the switch box into the stop position, a hydraulic member is actuated by means of a valve controlled by an electromagnet or by means of a slide valve; pressure of a liquid, usually Diesel oil delivered by a delivery pump and flowing out through a reducing valve back into a fuel tank, pushes a control bar of an injection pump into a position for stopping the supply of fuel into the engine.

A common drawback of hitherto known modifications of such prior device resides in the fact that electric current passes through the winding of the electromagnet controlling the said valve or slide valve during all of the time in which the engine is running; this increases the electric power consumption requirements of the engine.

A stopping device for an engine is also known wherein such drawback is obviated in that electric current does not pass through the winding of the electromagnet which is connected through a condenser to an electric power source by means of a switching relay, a hydraulic member, which may put the control bar of the injection pump into a zero position by means of hydraulic pressure, is connected to the waste piping, in which there is arranged an open valve, which is affected by a pre-stressed spring and controlled by an electromagnet, and is connected in parallel to a throttle nozzle; in this way, the hydraulic member is without pressure, and an attending member, such as a circuit breaker, is employed.

A disadvantage of the last-named device resides in the fact that to attain a sufficient intensity of current to close the valve for a desired interval needed for the reliable stopping of the engine, a condition which has sufficient capacity for the purpose is of very substantial size. And there is another drawback, that is, that after taking the key out of the switching box and after stopping the engine, it is possible for the control bar to be moved into a position wherein the injection pump supplies fuel into the engine. This fact makes it possible for the vehicle to be started without having the key in the switching box, e.g., by causing the vehicle to coast down a hill or pulling it by another vehicle, if the vehicle is not secured against misuse in some other way, e.g., by locking the driving mechanism, the gear box, etc.

The present invention has among its objects the provision of a device for stopping a fuel injection engine which requires for its operation during the operation of the engine a minimal electrical input, and the coil of the electromagnet which controls the said valve is de-energized during the operation, and for which a condenser of relatively small dimensions is sufficient. Finally, the device according to the invention provides that, after stopping the engine, the control bar of the injection pump is held in the position in which the injection pump does not supply the engine with fuel.

The above objects are attained by a device which has the following characteristics: an arm of a change-over switch is connected to the positive pole of a battery. The said arm has at least two other important positions besides its open position. When in the first important position, it engages a contact connected both to a winding of a switching relay, the other end of such relay being connected to ground, and by means of a conductor provided with a diode to a first fixed contact of the switching relay which is engaged by the arm of the switching relay when the current passes through its winding, and through the arm of the switching relay to one pole of a condenser, the other pole of the condenser being connected to ground.

The collector of an exciting transistor and the collector of the power transistor are connected in parallel to the positive pole of the battery. The other fixed contact of the switching relay is connected to the base of the exciting transistor, the emittor of which is connected to the base of the power transistor. One end of the winding of the electromagnet controlling the valve is connected to the emittor of the power transistor, the other end of such winding being connected to ground. If the arm of the change-over switch takes the other important position, it engages, by means of a segment, both the contact connected to the winding of the switching relay and the contact through which the positive pole of the battery by means of a conductor which connects it to the electric starter of the engine. Said last contact is connected to the winding of a pawl mechanism arranged on the electromagnet controlling the valve, the other end of such winding being grounded.

When the said electromagnet is energized, the pawl is pulled toward its core by the pressure of a spring. When the winding of the electromagnet of the pawl mechanism is de-energized, and if the valve controlled by the electromagnet is in its seat, a tooth of the revolving pawl, affected by the function of the spring, engages a face of the movable core of the electromagnet (solenoid) controlling the valve, which causes it to be held in the valve seat.

Another important feature of the invention resides in the fact that the diode is so oriented that electric current can pass only in the direction toward the first fixed contact of the switching relay.

In order that the invention may be clearly understood and readily carried into effect, a preferred embodiment thereof is, by way of example, hereinafter more fully described and illustrated in the accompanying drawings, in which:

The single FIGURE of the drawing is a schematic layout of the device.

The control bar 41 of an injection pump 4 is connected by a lost motion connection to the piston 51 of a hydraulic cylinder 5, the lost motion connection consisting of an arm 52 connected to the piston 51 and an L-shaped carrier member 521 within which the outer member of the control bar 41 slides, there being a motion-limiting cross pin 411 near the end of the control bar 41. A coil tension spring 53 extends between the left-hand end of the cylinder 5 and the upper end of the arm 52, whereby the piston 51 is constantly urged to the left, that is, in the direction of the working space 54 within the cylinder.

A pressure-reducing valve 6 is arranged in a waste piping 61 which extends between a filling chamber 42 of the injection pump 4 and the working space of an electromagnetically controlled hydraulic valve 8. A pipe 55 is connected to piping 61 between the reducing valve 6 and the valve 8 and extends to the left-hand end of the hydraulic cylinder 5 to communicate with the working space 54 therein. The reducing valve 6 keeps the desired overpressure of fuel in the filling chamber 42, usually approximately 0.1 up to 0.2 MPa. The reducing valve 6 opens toward the electromagnetic valve 8.

The filling chamber 42 of the injection pump is supplied from a supply sum or tank 1 through a pipe 21 to a delivery pump 2, which forwards fuel through pipe 32 to a filter 3 from which it flows through a pipe 31 to the filling chamber 42 of the injection pump.

The electromagnetic valve 8 has a movable valve element 81 of conical shape, which cooperates with a similarly shaped valve seat 88 to form a passage 85 of variable effective cross-section, fluid flowing from passage 85 through a pipe 89 and thence into the supply tank 1. The movable valve element 81 is connected to the movable core 82 of the solenoid of the electromagnetic valve 8, the solenoid having a winding 84, one end of which is connected to the ground. The solenoid core 82, and thus the movable valve or element 81, are constantly urged to the right by coil tension spring 83 connected between the solenoid core 82 and the right-hand end of the solenoid of the electromagnetic valve 8.

The other end of the winding 84 of the solenoid of the electromagnetic valve 8 is connected to the emittor 983 of a power transistor 98. One end of the winding 10 of a relay coil 9 is connected to ground; the other end of winding 10 is connected to a fixed contact 922 of a change-over switch 92, contact 922 being connected by a wire 955 through a diode 51 to a first contact 94 of the relay 9. The diode 51 is so oriented as to prevent current from flowing other than from the contact 922 to the contact 94. Relay 9 has a movable contact arm 93 the fixed but pivoted end of which is connected to one pole of a condenser 99, the other pole of condenser 99 being connected to ground, as shown.

A second fixed contact 96 of the switching relay 9 is connected to the base 971 of the exciting transistor 97, the emittor 973 of which is connected to the base 981 of the power transistor 98.

The collector 972 of the exciting transistor 97, as well as the collector 982 of the power transistor 98, are permanently connected to the positive pole of the battery 7, the negative pole of which is connected to ground.

The solenoid of the electromagnetic valve 8 is provided with a pawl mechanism, such mechanism having a rotary pawl 86 which is constantly thrust in a clockwise direction by a coil compression spring 861 so that the tooth 862 of the pawl engages the cylindrical surface of the core 82 of the solenoid. If the movable valve element 81 of the electromagnetic valve 8 is in engagement with the seat 88 of the valve, the tooth 862 of the rotary pawl 86 engages the end face surface 821 of the core 82, and in this manner the movable valve element 82 of valve 8 is held in engagement with the valve seat 88.

In order to retract the pawl 88 from engagement with the core 82, there is provided an electromagnet having a coil 87 which when energized pulls the pawl counterclockwise against the thrust of the spring 861. One end of the winding of the coil 87 is connected to ground, the other end being connected to the contact 923 of the change-over switch 92.

The change-over switch 92 has an arm 92′ with an electrically conducting segment 921 mounted thereon, arm 92′ being connected to the positive pole of battery 7. Depending upon the position of the key in the switching box (not shown) of the engine, the arm 92′ is selectively turned by the key from the zero position thereof, shown in the drawing, in which segment 921 does not engage either of contacts 922 or 923, or in either one of two important positions.

In the first important position (not shown) the segment 921 engages contact 922, and in the other important position the segment 921 engages both of the contacts 922 and 923. The position of arm 92′ wherein the segment 921 mounted thereon engages both contacts 922 and 923 is that which it occupies when the engine is started by means of an electric starter (not shown). The position of the arm 92′ in which segment 921 engages only contact 922 is that which it occupies when the engine is running.

In the position shown, the arm 92′ of the change-over switch occupies its zero position, that is, the position it occupies when the engine is stopped. In this case, after the previous stopping process, the valve 81 is held in the seat 88 by means of the tooth 862 of the rotary pawl 86 pulled by the spring 861.

The piston 51 of the cylinder 5 is in its right-hand limit position, and the carrier 521 holds both the pin 411 and the control bar 41 in the zero position, shown in tandem lines. Fuel cannot be pushed out of the working space 54 of the cylinder 5 by means of the spring 53, because the reducing valve 6 acts as a check-valve, and the movable valve element 82 of electromagnetic valve 8 is in its left-hand, valve closed position. In this way, it is impossible to start a fuel injection engine if the key is taken out of the switching box for the engine, that is for example by coasting the vehicle down to slow or by pulling it by another vehicle.

In the above-described situation, the coil or the switching relay 9 is without current, and the arm 93 of such relay is in engagement with its contact 96. The coil of the electromagnet 87 is also de-energized. When the arm 92′ of the change-over switch 92 is turned to its first operative position, that is, when the segment 921 engages the contact 922, electric current starts to pass through the coil 10 of the switching relay 9 and a magnetic field is created in this way, such field pulling the arm 93 down into engagement with contact 94. Thus current starts to pass from the contact 922 through the conductor 95, through the diode 51, and arm 93 into the condenser 99, which becomes charged in this manner. The arm 93, as well as the condenser 99, will stay in this condition during the whole period of the next operation of the engine.

When the key is operated to turn the arm 92′ further in a counterclockwise direction, so that the segment 921 engages both of contacts 922 and 923, current is fed into the winding of the electromagnet 87, the magnetic field of which pulls the pawl 86 upwardly, so that the tooth 862 becomes disengaged from the face surface 821 of the movable core 82 of the solenoid. Core 82 is then, by means of the spring 83, pulled to the right, so that the valve element 82 is pulled away from the valve seat 88, and the valve is opened. Fuel from the working space 54 of the cylinder 5 is then pushed through the now-opened passage 85 in the electromagnetic valve 8. This is accomplished by the moving of the piston 51 to the left under the influence of the spring 53, so that fuel goes back through the waste piping 61 into the fuel tank 1. In this way, the movement of the control bar 41 into the position for a starting dose of fuel is made possible by turning a lever (not shown) of a governor (not shown) of the injection pump 4. Simultaneously current from the battery 7 goes through a conductor (not shown) connected to the contact 923 into an electric starter (not shown) for the motor, such starter then rotating the engine in order to start it.

The engine having been started, the arm 92' of the change-over switch 92 assumes its first important position, in which it touches only the contact 922. The arm 92' stays in this position during the whole period of operation of the engine. When the engine is running, the winding 84 of the electromagnetic valve 8 controlling the position of the movable valve element 81 stays without current, and the valve 81 is kept in an open position by means of the coil tension spring 83. This makes possible a free outflow of fuel coming from the reducing valve 6 through the waste piping 61 into the fuel tank 1, so that the working space 54 of the hydraulic cylinder 5 is without any pressure. This is why the piston 51 is held by means of the pre-stressed coil tension spring 53 in its left limit position, and in this way the carrier 521 makes possible a free movement of the control bar 41 of the injection pump 4 over its whole working range. The rotary pawl 86 assumes the position shown in the drawing. A very small current passes through the coil 10 of the switching relay 9, and the arm 93 thereof is held in engagement with the fixed contact 94, this assures that the condenser 99 is in a charged condition.

When the engine is stopped, the arm 92' of the change-over switch 92 is put into the zero position thereof shown; in this position the segment 921 is not in contact with either of the contacts 922 and 923. In this way, current coming from the battery 7 into the winding of the switching relay 9 is cut off. The diode 51, which allows current to pass only in the direction from the contact 922 to the contact 94 of the switching relay 9, assures that the charged condenser 99 will not be discharged through the winding of the switching relay 9.

The magnetic field of the switching relay 9 having disappeared, the elasticity of the arm 93 causes such arm to engage the other fixed contact 96, as shown in the drawing, and in this way the positive pole of the charged condenser 99 and the base 971 of the exciting transistor 97 are interconnected. As voltage from the battery 7 is imposed across the collector 972 of the exciting transistor 97, current from the condenser 99 passes through the emitter 973 to the base 981 of the power transistor 98. After voltage across the condenser 99 appears at the base 981, the power transistor 98 opens and makes it possible for current to pass from the positive pole of the battery 7 through the collector 982 and the emittor 983 of the power transistor 98 into the winding 84 of the electromagnetic valve 8 which controls the movable valve element 81. By means of the thus created magnetic field of electromagnet 8, the movable core 82 thereof is pulled against the tension of the spring 83, and the movable valve element 81 is forced into engagement with the seat 88. Simultaneously, the spring 861 turns the rotary pawl 86, the tooth 862 of which engages and face surface 821 of the movable core 82, and in this way the valve element 81 is held in engagement with the valve seat 88.

The valve 81, 88 being closed, all fuel behind the reducing valve 6 goes through the piping 55 into the working space 54 of the hydraulic cylinder 5, and its pressure shifts the piston 51 against the opposition of the spring 53 into the right-hand limit position thereof; simultaneously, the carrier 521 engages the pin 411 and it shifts the control bar 41 into the zero position, in which the injection pump stops delivering fuel into the engine, and the engine stops.

An advantage of such an arrangement resides in the fact that the winding 84 of the electromagnetic valve 8 is connected directly to the voltage of the battery 7; the condenser 99 determines only the time of said connection. The greater capacity of the condenser 99, the longer is the time of such connection. The necessary capacity of the condenser 99 and its dimensions may be very small for the interval of several seconds that is needed for a reliable stopping of the engine, and this fact is very advantageous.

Because, after current in the winding 84 of the electromagnetic valve 8 has been cut off, the valve element 82 is held in engagement with the seat 88 by means of the rotary pawl 86 and spring 861, the piston 51 of the hydraulic cylinder 5, with the carrier 521 and control bar 41, stay in the zero position until the next starting of the engine. This arrangement makes it impossible for the vehicle to be misused by starting the engine without a key, e.g., by coasting the vehicle down a slope or by pulling it with another vehicle.

Although the invention is illustrated and described with reference to one preferred embodiment thereof, it is to be expressly understood that it is in no way limited to the disclosure of such a preferred embodiment, but that it is capable of numerous modifications within the scope of the appended claims.

I claim:

1. In a combination including a fuel injection engine, the fuel supply for the engine being provided by an injection pump having a control bar, said injection pump being filled by a delivery pump, excess fuel being returned through a pressure-reducing valve and thence to a fuel supply sump, an electromagnetic valve being interposed in the piping which returns the superfluous fluid to the fuel tank, there being a hydraulic member the working space of which is connected by means of piping to the conduit returning the superfluous fluid between the pressure reducing valve and the electromagnetic valve, the electromagnetic valve being constantly urged by a pre-stressed spring into an open position, the said hydraulic member, by means of hydraulic pressure being adapted to place the control bar of the fuel injection pump into a position in which the injection pump does not supply the engine with any fuel, the hydraulic member being selectively controlled as by a hand operated change-over switch, a switching relay, an exciting transistor, and a power transistor, the improvement comprising: a battery, and a device for stopping the engine wherein an arm of the change-over switch is connected to the positive pole of the battery, the said arm having at least two other possible positions besides its open position, when in the first other position the arm engaging a contact connected both to a winding of a switching relay, the other end of such relay being connected to ground, and by means of a conductor to a first contact of the switching relay which is engaged by the arm of the switching relay when the current passed through its winding, and through the arm of the switching relay to one pole of a condenser, the other pole of the condenser being connected to ground, the collector of an exciting transistor and the collector of the power transistor being connected in parallel to the positive pole of the battery, the other fixed contact of the switching relay being connected to the base of the power transistor, one end of the winding of the electromagnetic valve being connected to the emitter of the power transistor, the other end of such winding being connected to ground, when the arm of the change-over switch is in the second of the other possible positions, it engages, by means of a segment, both the contact connected to the winding of the switching relay and the contact through which the positive pole of the battery by means of a conductor which connects it to the electric starter of the engine, said last contact being connected to the winding of a pawl mechanism arranged on the electromagnetic valve, the other end of such winding being grounded, when the said electromagnetic valve is energized, the pawl being pulled toward its core by the pressure of a spring, when the winding of the electromagnet of the pawl mechanism is de-energized, and if the electromagnetic valve is in its seat, a tooth of the revolving pawl, affected by the function of the spring, engages a face of the movable core of the electromagnetic valve, which causes it to be held in the valve seat.

2. A device as claimed in claim 1, comprising a diode interposed in the conductor, the diode being so directed so that it makes it possible for electric current to pass only in the direction to the first fixed contact of the switching relay.

3. A device for stopping a fuel injection engine comprising an injection pump having an inlet for receiving fuel from a fuel tank and an outlet for returning excess fuel to the tank by way of a fuel return line including a pressure-reducing valve and an electromagnetically operated valve having a prestressed spring biasing the valve towards an open position when the engine is running, control means including a control switch arranged to close the electromagnetic valve when the switch is operated to an off-position thereby to prevent the return of fuel to the tank, said control means being arranged to energize the electromagnet of said electromagnetic valve only for a short time to close the valve and to stop the engine, hydraulic means having a cylinder coupled to the fuel return line at a position intermediate the pressure-reducing valve and the electromagnetic valve, and a piston coupled to a control member arranged to control the delivery of fuel to the engine, the piston having a first, extended position whereat the control member is arranged to prevent the delivery of fuel to the engine and resilient means biasing the piston away from its said first position, the arrangement being such as that, in operation, when said switch is operated to its off-position the electromagnetic valve is closed so that the returned fuel is directed to said cylinder and causes said piston to move to its first, extended position whereby the control member stops further delivery of fuel to stop the engine, and further comprising electromagnetically operated locking means arranged when the valve is closed automatically to lock it in said closed position by a prestressed spring, and making said valve free by an electromagnet only when said switch is operated to its position for starting the engine.

* * * * *